United States Patent [19]

Szego, deceased

[11] 4,063,687

[45] Dec. 20, 1977

[54] COMMINUTION DEVICE

[75] Inventor: Laszlo L. Szego, deceased, late of Toronto, Canada, by Cynthia Szego, administratrix

[73] Assignee: General Comminution Inc., Toronto, Canada

[21] Appl. No.: 764,328

[22] Filed: Jan. 31, 1977

Related U.S. Application Data

[63] Continuation of Ser. No. 614,567, Sept. 18, 1975, abandoned.

[51] Int. Cl.[2] ..... B02C 15/08

[52] U.S. Cl. ..... 241/110; 241/127; 241/132; 241/133

[58] Field of Search ..... 241/110, 111, 114, 123, 241/127, 128, 129, 130, 131, 132, 133

[56] References Cited

U.S. PATENT DOCUMENTS

| | | | |
|---|---|---|---|
| 410,758 | 9/1889 | Griffin | 241/130 |
| 1,349,235 | 8/1920 | Stout | 241/131 |
| 3,764,079 | 10/1973 | Consoli | 241/110 |
| 3,840,190 | 10/1974 | Consoli | 241/131 |

*Primary Examiner*—Granville Y. Custer, Jr.
*Attorney, Agent, or Firm*—Rogers, Bereskin & Parr

[57] ABSTRACT

A comminution device in which a crushing mass having an outer surface of helical configuration is mounted on a rotary support which rolls the crushing mass around the interior surface of a crushing chamber. The helical surface provides improved comminution. The rotary support is a flexible wire rope which permits limited radial movement of the crushing mass, allowing centrifugal force to aid the comminution. The crushing mass is mounted at about the midpoint of the wire rope, allowing gyroscopic forces to further assist the comminution.

6 Claims, 13 Drawing Figures

COMMINUTION DEVICE

This is a continuation of application Ser. No. 614,567, filed Sept. 18, 1975, was abandoned.

This invention relates to apparatus for processing materials. Specifically, it relates to apparatus which may be used for comminuting particulate material, or which may be used for mixing materials or for other purposes, as will be described.

Numerous devices exist for obtaining very fine material by comminution. These devices are generally complex and expensive, and the degree of fineness to which they can comminute material is usually limited.

The present invention provides two improvements, which may be used separately or together, in a device for comminuting or otherwise processing material. According to one improvement, a mass in the form of a helix is rotated in a chamber. The helical form of the mass has various advantages which will be discussed. According to the other improvement, the mass is mounted on a flexible axle, for example a wire rope. This provides good support for the mass, yet permits it to move radially under centrifugal force and to tilt on its axis. Thus, as the mass rotates, a combination of centrifugal and gyroscopic forces act on it to crush or otherwise process material located between it and the chamber wall. Usually, but not necessarily, both improvements will be used together.

Although devices according to the invention are intended primarily to provide finely comminuted material, they may also be used for mixing or homogenizing liquids, mixing solid particles, mixing particles with liquids, or they may be used as chemical reactors, comminuting material to provide reactive surfaces which may react with other materials present.

Further features of the invention will appear from the following description, taken with the accompanying drawings, in which.

Figure 1:
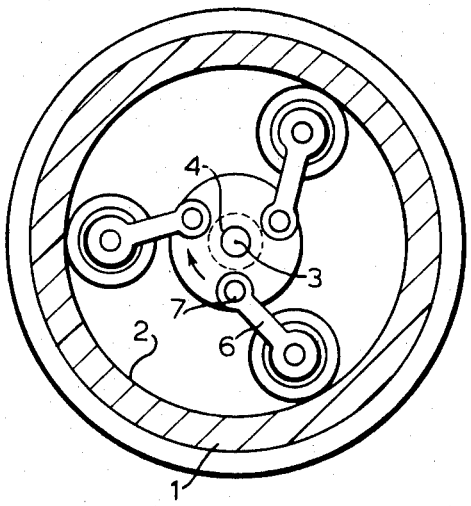
FIG. 1 is a schematic top view, partly in section, showing a first embodiment of the invention.
Figure 2:
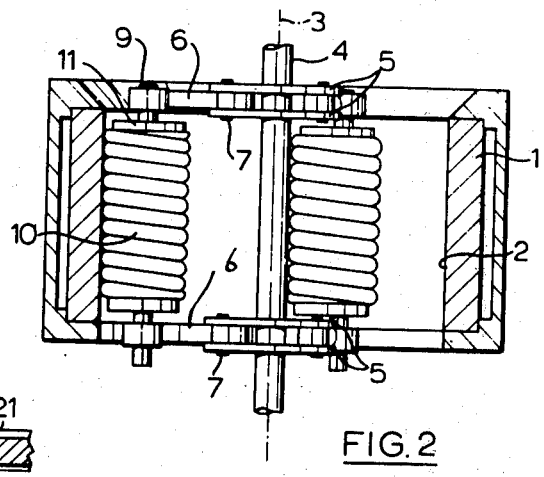
FIG. 2 is a sectional elevation of the FIG. 1 device.

Reference is first made to FIGS. 1 and 2, which show a device having a circular chamber 1. The chamber 1 has an interior surface 2 which is cylindrical and symmetrical about the central axis 3 of the device. A central axle 4 is provided, carrying two pairs of support rings 5 spaced in pairs on the axle, approximately at the upper and lower limits of the chamber 1.

Three pairs of swinging arms 6 are provided. The arms 6 of each pair are vertically spaced apart and are opposed to each other, and the pairs are spaced at 120° intervals around the support rings 5. Each arm 6 is mounted between a pair of support rings 5 and is held in place by a pin 7 passing through aligned holes in the rings and through the inner end of the swinging arm 6, so that the arms 6 are free to rotate about the pin 7.

The outer ends of each pair of swinging arms 6 house the ends of an axle 9 of a rotatable mass 10. The mass 10 is rotatably suspended on the axle 9 by a suitable bearing mechanism, not shown. Axial movement of the mass 10 is prevented by stop rings 11.

As shown, the swinging arms 6 are sightly longer than the minimum length required to allow the outer portion of the mass 10 to touch the inner surface 2. Therefore, each pair of arms extends at an angle to a radius drawn from the central axis 3 through the pins 7 of the pair of arms 6. The direction of rotation of the assembly in operation is indicated by the arrow in FIG. 1 (clockwise), and preferably the arms 6 trail rearwardly of the direction of rotation.

In FIGS. 1 and 2 the mass 10 is formed as a cylindrical helix of any heavy durable material such as hardened steel. Each turn of the helix lies tightly against the other as shown in FIG. 2.

When the central axle 4 is rotated (by means not shown), the support rings 5, arms 6, and masses 10 all revolve as an assembly about the central axis 3. Centrifugal force tends to straighten the arms 6 and press the masses 10 against the inner surface 2 of the chamber 1. In addition, since each mass 10 is free to rotate about its own axis, the contact between each mass 10 and surface 2 causes each mass 10 to roll around the inner surface while rotating about its own axis. Each mass 10 exerts against the surface 2 a pressure due to centrifugal force, the extent of such pressure depending on the weight of the mass and the speed of rotation of the assembly. This pressure may be utilized for crushing particulate material to a very fine powder, or as previously indicated it may be used to mix materials, or homogenize liquids, or for other material processing as required. The material to be processed may be fed into the chamber 1 and the processed material removed by any conventional means, not shown.

When the mass 10 is a closely wound helical coil as shown in FIGS. 1 and 2, each turn may be of generally circular cross-section so that each turn presents a point of contact with the inner surface 2 at any given position. Because of the flexible nature of the helix, some turns may be displaced from the inner surface 2 by the particles being crushed, without removing the other turns from contact with the inner surface. Further, because each turn of the helix is connected to all of the other turns, when any particular point of contact encounters a particle to be crushed, there will be a pressure exerted on a particle being crushed which is greater than the force that would be exerted by the mass of a single turn. There will be a force contributed by the surrounding turns of the helix.

The configuration of the helix can be arranged so that the progressive points of contact move progressively in the direction of the particle flow as the mass rolls, thus assisting movement of the material from the inlet to the outlet of the chamber as it passes through the chamber 1. Alternatively, the helix may be mounted so that when rolled, the turns of the helix tend to retard the progression of particulate material from the inlet to the outlet, thereby subjecting the material to a longer period of treatment and resulting in finer crushing or more complete mixing.

Although three masses 10 are shown in FIGS. 1 and 2, only one mass 10 may be used, although in such event a counterweight would normally be provided to restore the balance provided by the omitted masses 10.

Figure 3:
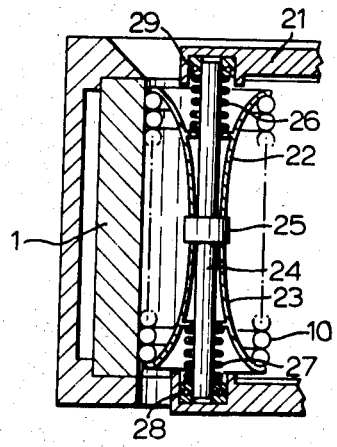
FIG. 3 is a cross-section of an alternative embodiment of the device of FIGS. 1 and 2, having a flexible mounting.

The second major improvement provided by the invention is shown in FIG. 3. FIG. 3 shows alternative means for suspending each mass 10. FIG. 3 also shows a helical mass 10, but other forms for the mass 10 may also be used, as will be described.

In the FIG. 3 design the swinging arms 6 are replaced by rigid arms 21 radially extending from an axle such as the axle 4 of FIG. 1. The mass 10 is supported on the arms 21 by two cone shaped members 22, 23 which are in turn mounted on a flexible axle 24 journalled in the ends of the arms 21. The cone shaped members 22, 23 are maintained in position by a central collar 25 clamped to the axle 24 at its mid point, and by the thrust of springs 26 and 27 which bias the cone-shaped members 22, 23 towards each other. Bearings 28, 29 are provided at the ends of the arms 21 to journal the axle 24 for rotation.

The axle 24 is a slender rod of spring steel or other flexible material which allows the mass 10 to tilt slightly on its axis of rotation. The dimensions of the arms 21 are such that the mass 10 is normally in contact, with moderate pressure, against the surface 2 of the crushing chamber 1.

When the arms 21 of the FIG. 3 embodiment are rotated, the masses 10 again rotate about the central axis of the device, and each mass 10 also rotates about its own axis. However, when a particle to be crushed moves between one end of the mass 10 and the surface 2, this tends to cause the mass 10 to tilt. The tilting of the rapidly rotating mass about its own axis creates a gyroscopic restoring force which tends to restore the axis of the mass to its original position, causing an additional crushing force to be exerted on the particle.

Figure 4:
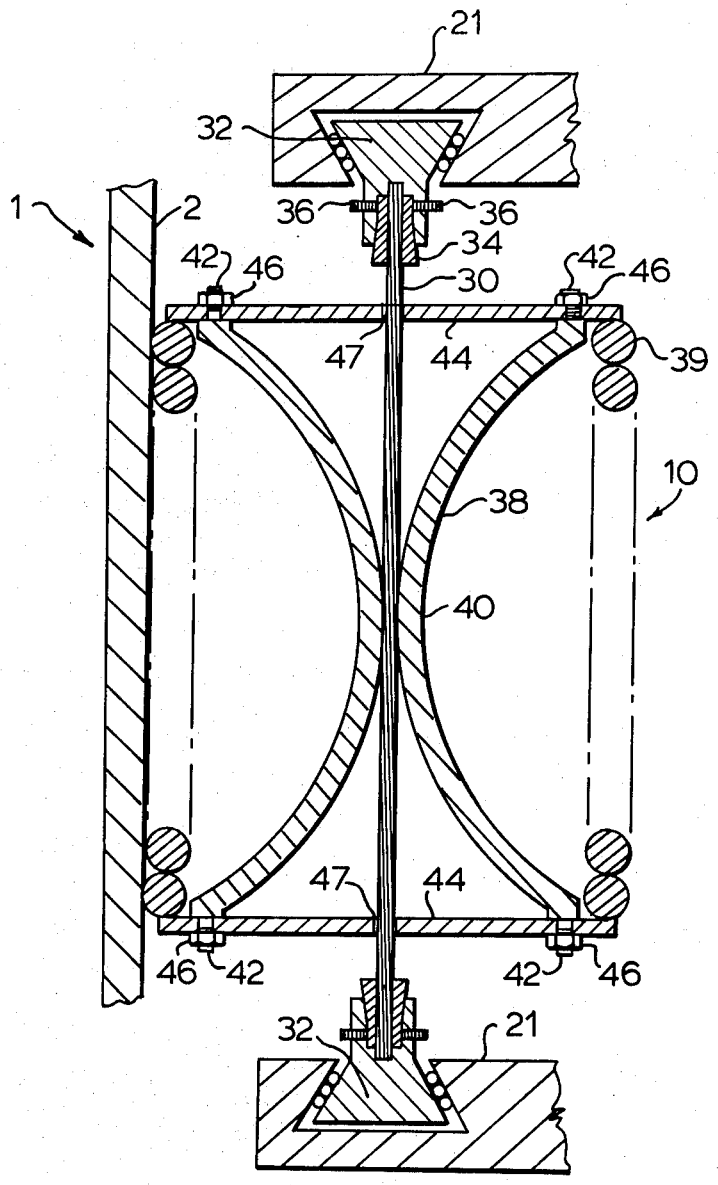
FIG. 4 is a cross-sectional view showing a modification of the FIG. 3 embodiment.

Instead of using as the axle 24 a flexible rod or shaft as shown in FIG. 3, alternatively a wire rope may be used. Such an arrangement is shown in FIG. 4, which shows a device similar to that of FIG. 3 except that each mass 10 is now supported on a wire rope 30, which serves as an axle for the mass 10. The rope 30 is clamped at each end in bearings 32 which in turn are journalled at the outer ends of the arms 21. Any suitable securing means may be employed for the wire rope, for example semi-circular wedges 34 held in position by set screws 36.

The mass 10 is held to the axle on rope 30 as follows. An hour-glass shaped support 38 (similar to the two cone shaped members 21, 23) is provided, welded or clamped (by means not shown) at its centre 40 to the mid-point of rope 30. The diameter of the support 38 at its ends is less than the interior diameter of the helical coil 39, to allow the coil 39 to be slipped onto the support 38. Studs 42 project vertically from the support 38 through holes in retaining caps 44 which retain the mass 10 in position on the support. Nuts 46 secure the caps 44 to the studs 42. The caps 44 include holes 47 through which the wire rope 30 passes.

The wire rope 30 provides considerably improved flexibility as compared with the flexible rod shown in FIG. 3. The wire rope 30 allows the masses 10 to be mounted so that when they are at rest, they are only in very light contact with the interior surface 2 of the chamber 1, or are spaced very slightly inwardly of the surface 2. When the arms 21 are rotated, the flexibility and resilience of the wire rope 30 is sufficient to allow the masses 10 to move outwardly into contact with the surface 2. If desired, a small amount of slack can be left in the wire rope to ensure adequate radial movement of the mass 10. The added flexibility of the wire rope further permits increased tilting of the crushing masses 10 on their axes of rotation. This enables comminution of larger particles, increases the gyroscopic forces available and reduces the accuracy of the tolerances needed.

If desired, a flexible axle mounting, such as that provided by axle 24 or wire rope 30, may be used with the swinging arms 6 instead of with fixed arms 21.

Figure 5:
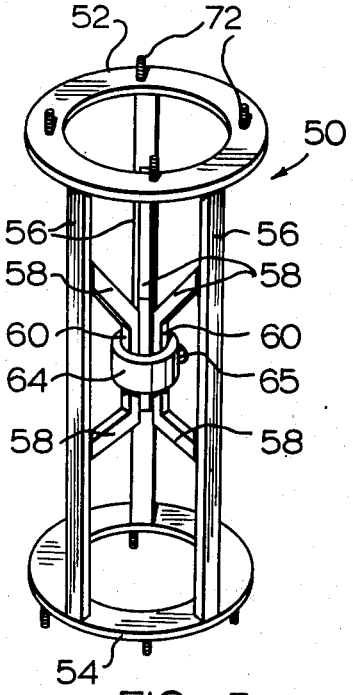
FIG. 5 is a perspective view showing a support for a non-helical rotating mass.
Figure 6:
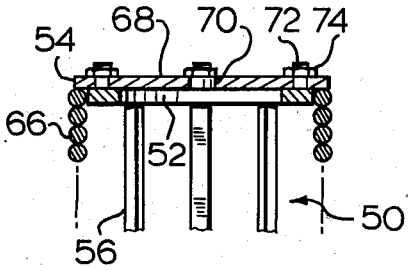
FIG. 6 is a side sectional view of a portion of the FIG. 5 support and showing rings in place thereon.
Figure 7:
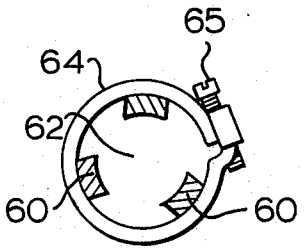
FIG. 7 is a top sectional view showing how the FIG. 5 support is clamped to a wire rope.

The mass 10 has been shown as a helix, but other forms of the mass 10 may be used in any of the embodiments described. An example of an alternative form for the mass 10 is shown in FIGS. 5 to 7. In FIG. 5 there is shown a frame 50, having upper and lower rings 52, 54 joined by three longitudinal struts 56. Secured to each strut 56 is an inwardly extending generally U-shaped strut 58 having a central straight portion 60 the interior surface of which is concave to fit the outer surface of the rope 30. The central straight portions 60 together define a close-fitting gap 62 (FIG. 7) through which the wire rope 30 may pass. A clamp ring 64 operated by a screw 65 is provided to draw the straight portions 60 into close engagement with the wire rope, to secure the frame 50 on the wire rope.

The exterior surface of the crushing mass is constituted by a number of stacked rings 66 (FIG. 6). The rings 66 are located in their correct position by the longitudinal struts 56 and are prevented from sliding off the top or bottom of the frame 50 by end caps 68. The end caps 68, which include apertures 70 through which the wire rope may pass, are mounted on studs 72 projecting from the rings 52, 54 and are held in place by nuts 74.

It will be appreciated that a helical coil or other form of crushing mass may also be placed on the frame 50.

Figure 8:
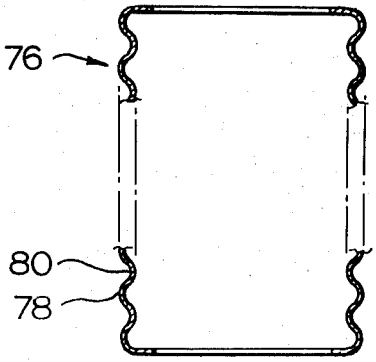
FIG. 8 is a cross-sectional view showing an alternative surface for a rotating mass.

A still further configuration for the crushing mass is shown at 76 in FIG. 8. The crushing mass 76 is a unitary sleeve having an exterior surface formed in the shape of ridges 78 and grooves 80. The ridges and grooves 78, 80 may assume a sinusoidal configuration as viewed in cross-section, or other appropriate contours may be used, depending on the application. The sleeve 76 may be used with the frame 50 shown in FIG. 5, or with other suitable support means.

Figure 9:
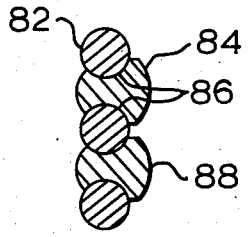
FIG. 9 is a cross-sectional view showing a portion of another alternative surface for a rotating mass.
Figure 10:
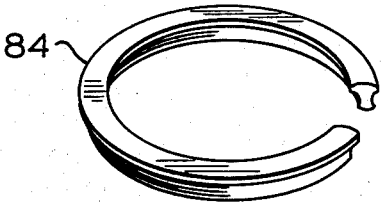
FIG. 10 is a perspective view of a portion of an insert for the FIG. 9 surface.

A portion of a still further modification of the crushing surface is shown in FIG. 9. FIG. 9 shows three turns of a helically wound coil 82. The turns of the helix are spaced apart, permitting insertion between the turns of an insert 84. The insert 84 is formed of specially hardened material, e.g. hardened steel, and is generally T-shaped in cross-section. The sides of the leg of the T, and the bottom of the bar of the T, have a curved contour indicated at 86, to accommodate closely the turns of the coil 82, while the outer surface of the bar of the T is formed with a gently curved crushing surface 88. The insert 84 may be formed as a single unitary strip, or it may be formed in short sections as shown in FIG. 10, so that when individual sections of the insert become worn, they may be replaced without replacing the entire insert. The exterior surface 88 of the insert may be formed with any appropriate contour, depending on the application of the unit.

Figure 11:
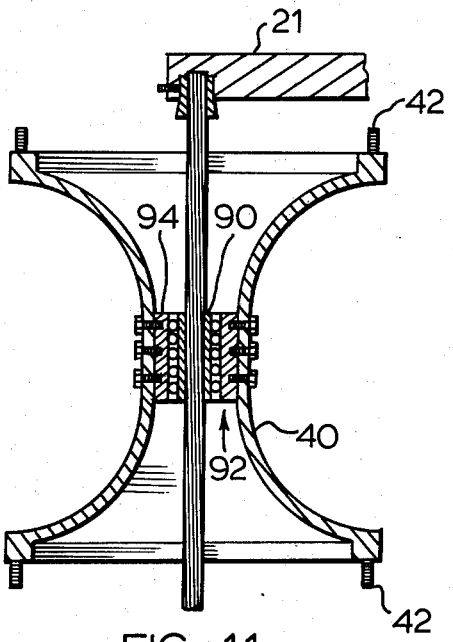
FIG. 11 is a cross-sectional view showing a modification of the FIG. 4 device.

If desired, the mass 10 may be mounted for rotation on its own axle, and the axles may be fixed relative to their supporting arms. Such an arrangment is shown in FIG. 11, which shows an arrangement identical with that of FIG. 4 except for this change. In FIG. 11 the inner race 90 of a bearing 92 is welded or otherwise secured to the mid-point of the wire rope 30. The outer race 94 of the bearing 92 is bolted or otherwise secured to the support or frame 40. The support or frame 40 is now free to rotate on the wire rope, and the wire rope 30 is therefore simply clamped or otherewise secured in the ends of the arms 21.

Figure 12:
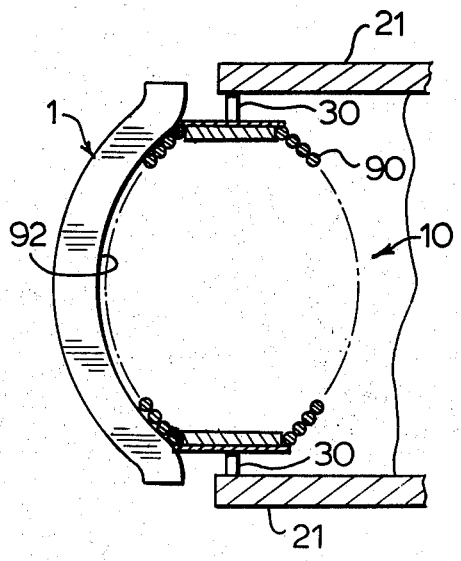
FIG. 12 is a cross-sectional view showing a modification of the FIG. 11 device.
Figure 13:
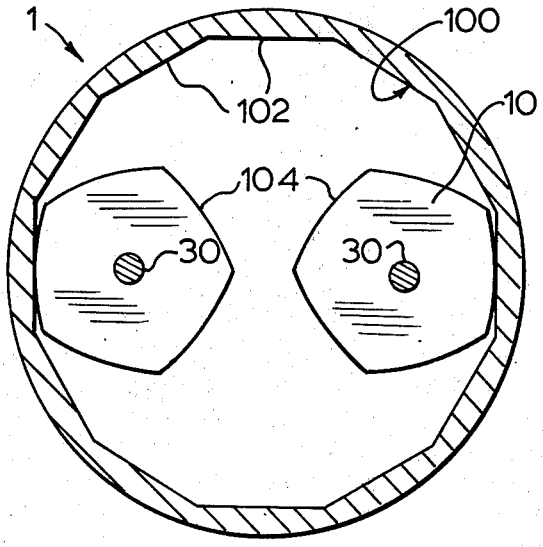
FIG. 13 is a top view showing an alternative form of chamber and rotating mass.

Reference is next made to FIG. 12, which shows the crushing mass 10 as being in the form of a helically wound coil having a convex outer surface 90. The inner surface of the chamber 1 is indicated at 92 and is concave, having a curvature corresponding axially to that of the mass 10. Other non-linear configurations may be used, depending on the application. Normally, however, the mass 10 will have the contour of a body of revolution (i.e. any cross-section taken at right angles to its axis will be a circle), but if desired, the mass 10 may have a different contour, so long as the chamber 1 has a cooperating contour so that there will be continual rotary contact between the mass 10 and the chamber's inner surface. An example of such an arrangment is shown in FIG. 13, where the chamber 1 has a polygonal inner surface 100 having facets 102. The masses 10 have faces 104 which match in circumferential extent the facets 102.

In addition, if desired the inner surface of the chamber 1 may be made slightly elliptical, preferably with sufficient scope for radial movement of the masses 10 so that they will remain in contact with the inner surface of the chamber as they are rotated. This arrangement leads to oscillating forces, which are normally undersirable, but it creates a crushing or mixing force which varies around the chamber circumference (and which may fall to zero at the long ends of the ellipse). This is a situation which may be desirable in special applications.

Although it is preferred, when the masses 10 are supported by a flexible axle, that the masses be clamped to the mid-point of the axle, nevertheless the masses 10 can if desired be provided with clamps e.g. on the end caps 47. The end caps 47 would then be clamped to the axle. However this arrangement is less desirable since it reduces the tilting that the mass 10 can undergo.

A crushing mass in which the outer surface has a helical configuration can be used with a mounting which permits no radial movement of the mass (although this is not preferred) or such a mass can be used with various forms of mountings which permit radial movement. For example, such a crushing mass can be mounted on slides which permit movement having a radial component only, or it can even be mounted on bearings or on a shaft with sufficient tolerance or looseness to permit the required degree of radial movement.

What I claim is:

1. Material processing apparatus comprising:

a. a mass having a first central longitudinal axis and having an outer surface, b. a chamber having a second longitudinal axis parallel to said first axis and having an inner surface of contour conforming axially substantially to that of said outer surface, c. rotary support means rotatable about said second axis and supporting said mass for free rotation about said first axis and for contact of said outer surface with said inner surface, d. drive means for rotating said rotary support means to rotate said mass around said inner surface, e. said rotary support means including a pair of longitudinally spaced apart support arms, a flexible wire rope extending along said first axis between said support arms, means rotatably journaling one end of said rope in each support arm for rotation of said wire rope about said first axis, and means mounting said mass on said rope approximately at the mid-portion of said rope, said rope thereby constituting a flexible axle supporting said mass and to enable tilting of said mass about said first axis, so that under rotation imparted by said drive means to said rotary support means, said mass will be impelled under centrifugal force generally radially outwardly of said rotary support means and will be pressed into contact with said inner surface of said chamber and will roll therearound, and so that said mass may tilt in the presence of a particle located between said outer surface of said mass and said inner surface of said chamber, thereby applying a crushing force constituted by both centrifugal and gryoscopic forces, against said particle.

2. Apparatus according to claim 1 wherein said mass has an outer surface having a helical configuration.

3. Apparatus according to claim 1 wherein said mass comprises a helically wound coil having spaced apart turns, and a helical insert located between said turns, said insert having an exterior surface projecting beyond the exterior surface of said turns of said coil, the surface of said insert constituting the exterior surface of said mass.

4. Material processing apparatus comprising:

a. a mass having a first central longitudinal axis and having an outer surface, b. a chamber having a second longitudinal axis parallel to said first axis and having an inner surface of contour conforming axially subtantially to that of said outer surface, c. rotary support means rotatable about said second axis and supporting said mass for free rotation about said first axis and for contact of said outer surface with said inner surface, d. drive means for rotating said rotary support means to rotate said mass around said inner surface, e. said rotary support means including a pair of longitudinally spaced apart support arms, a flexible wire rope extending along said first axis between said support arms and connected at its ends to said support arms, means rotatably mounting said mass on said wire rope approximately at the mid-point of said rope for rotation on said rope, said rope thereby constituting a flexible axle supporting said mass to enable radial movement of said mass and to enable tilting of said mass about said first axis, so that under rotation imparted by said drive means to said rotary support means, said mass will be impelled under centrifugal force generally radially outwardly of said rotary support means and will be pressed into contact with said inner surface of said chamber and will roll therearound, and so that said mass may tilt in the presence of a particle located between said outer surface of said mass and said inner surface of said chamber, thereby applying a crushing force constituted by both centrifugal and gyroscopic forces, against said particle.

5. Apparatus according to claim 4 wherein said mass has an outer surface having a helical configuration.

6. Apparatus according to claim 4 wherein said mass comprises a helically wound coil having spaced apart turns, and a helical insert located between said turns, said insert having an exterior surface projecting beyond the exterior surface of said turns of said coil, the surface of said insert constituting said exterior surface of said mass.

* * * * *